US006656412B2

(12) United States Patent
Ercelebi et al.

(10) Patent No.: US 6,656,412 B2
(45) Date of Patent: Dec. 2, 2003

(54) COMPACTION SYSTEM FOR PARTICLES IN PARTICLE FILLED CAVITIES OF AN ARTICLE

(75) Inventors: Ahmet Ercelebi, Richmond, VA (US); Martin T. Garthaffner, Chesterfield, VA (US); Janet L. Thompson, Chesterfield, VA (US); Steven Frederick Spiers, Richmond, VA (US)

(73) Assignee: Philip Morris Incorporated, New York, NY (US)

( * ) Notice: Subject to any disclaimer, the term of this patent is extended or adjusted under 35 U.S.C. 154(b) by 16 days.

(21) Appl. No.: 09/931,241

(22) Filed: Aug. 17, 2001

(65) Prior Publication Data

US 2003/0034590 A1 Feb. 20, 2003

(51) Int. Cl.[7] ..... B30B 9/28

(52) U.S. Cl. ..... 264/518; 264/112; 264/120; 264/121; 264/DIG. 48; 425/115; 425/335; 425/337; 493/42; 493/47; 493/48

(58) Field of Search ..... 493/42, 47, 48; 264/112, 120, 121, DIG. 48, 101, 518; 425/110, 115, 363, 335, 337

(56) References Cited

U.S. PATENT DOCUMENTS 3,259,029 A 7/1966 Hall et al.
3,354,887 A * 11/1967 Hall
3,365,749 A * 1/1968 Pinkham
3,464,324 A 9/1969 Pinkham
3,566,753 A * 3/1971 Mantke
3,625,118 A 12/1971 Jackson
3,844,200 A 10/1974 Sexstone
4,010,678 A * 3/1977 Greve et al.
4,252,527 A * 2/1981 Hall ..... 493/42
4,285,678 A 8/1981 Molins
4,412,829 A * 11/1983 Lebet et al. ..... 493/48
4,541,826 A 9/1985 Warner
4,614,554 A * 9/1986 Bate et al. ..... 264/109
5,542,901 A * 8/1996 Atwell et al. ..... 493/47
5,809,744 A 9/1998 Villines et al.

OTHER PUBLICATIONS

US Patent Office, Dec. 1994, pp. 66–67.*
Notification of Transmittal of the International Search Report or the Declaration for PCT/US02/25836 dated Dec. 2, 2002.

* cited by examiner

*Primary Examiner*—Robert Davis
(74) *Attorney, Agent, or Firm*—Burns, Doane, Swecker & Mathis, LLP

(57) ABSTRACT

A method and apparatus for compacting particles or granules in discrete cavities spaced along an article or articles such as a cigarette filter rod moved underneath the compacting system. The compacting system can be provided with spaced lugs or other protrusions that selectively compact particles within cavities, or a smooth outer periphery that results in progressive compaction of the entire article being moved underneath the compaction system. The article having cavities with particles that need to be compacted can be supported on a support rail with side support rails that maintain the shape of the article during the compaction process.

36 Claims, 4 Drawing Sheets

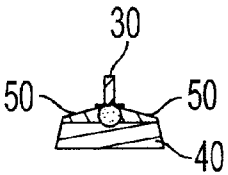
FIG. 1B
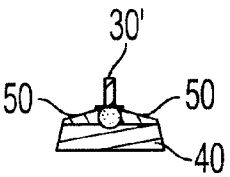
FIG. 1A
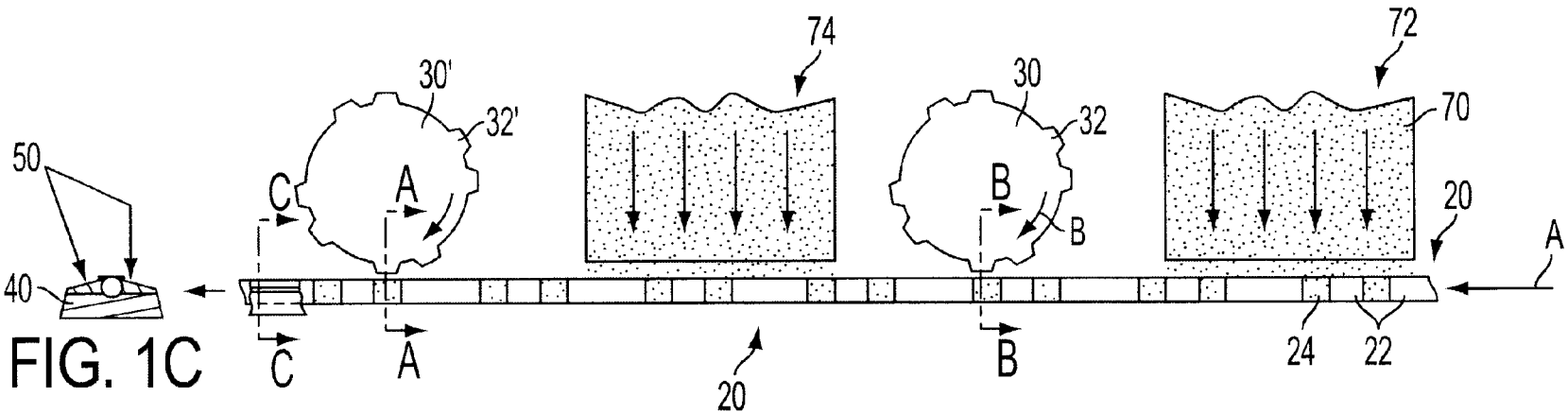
FIG. 1
FIG. 1C

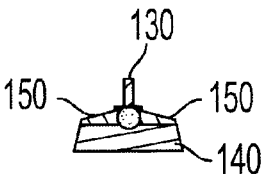
FIG. 2B
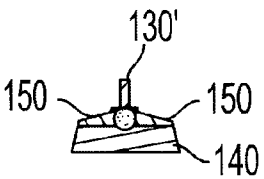
FIG. 2A
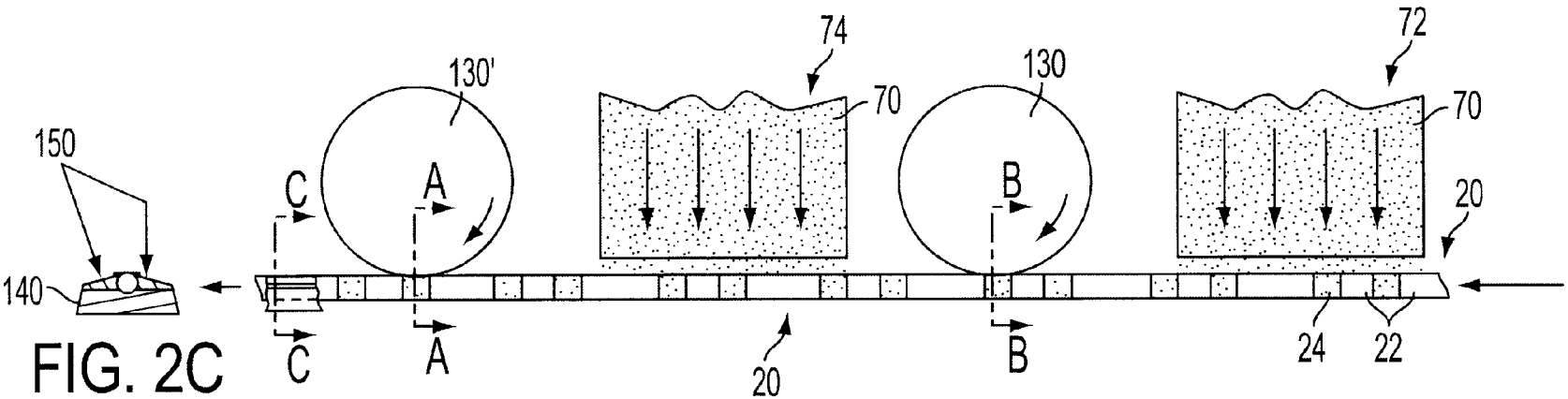
FIG. 2
FIG. 2C

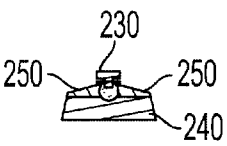
FIG. 3B
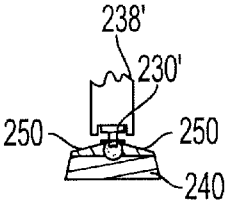
FIG. 3A
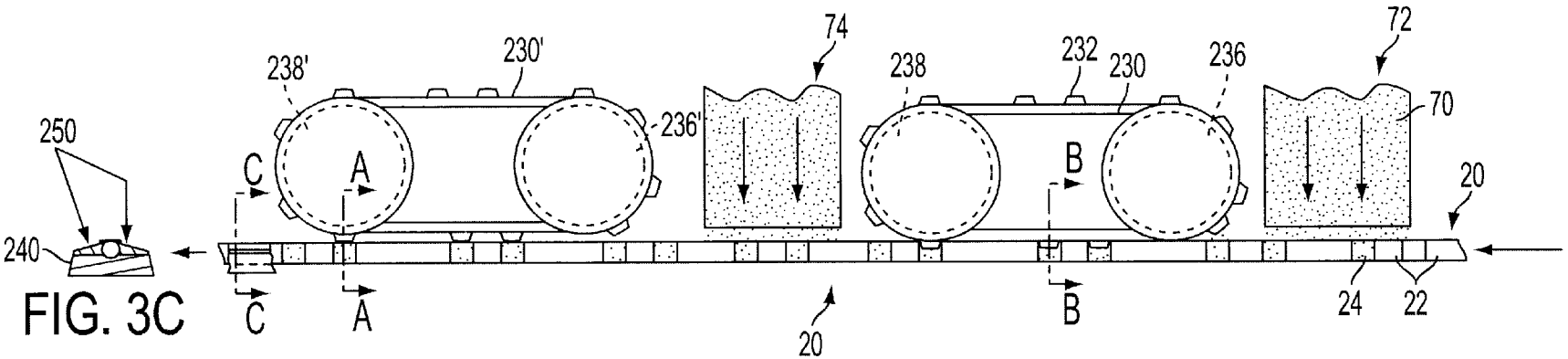
FIG. 3
FIG. 3C

COMPACTION SYSTEM FOR PARTICLES IN PARTICLE FILLED CAVITIES OF AN ARTICLE

FIELD OF THE INVENTION

The present invention relates generally to methods and apparatus for firmly packing particles or granules in spaced cavities of an article or articles such as cigarette filter rods being moved along a manufacturing line.

BACKGROUND OF THE INVENTION

Certain articles of manufacture such as charcoal cigarette filters, individual-size packets of granular food products or condiments, capsuled pharmaceuticals, ammunition and the like may require that cavities be completely filled with particles or granules, with the particles being compacted to a desired density or firmness. Several methods exist for adding particles to empty cavities in an article such as a combined filter rod for a cigarette, or other article or articles having spaced cavities. In a cigarette filter rod, for example, cavities to be filled with particles can be spaced in between other filter components. One method for filling the cavities in a cigarette filter rod with particles includes showering the entire filter rod with the particles to allow the particles to fill the spaced cavities. Another method of filling the cavities with particles includes a lug chain that follows the rod as it travels and deposits particles through the lugs into the cavities. Yet another method of filling the cavities with particles uses a pocketed vacuum wheel. The pocketed wheel is driven in synchronization with the filter rod and has internal vacuum which pulls particles into the pockets. As each pocket reaches a corresponding filter rod cavity, the particles are blown from the wheel pocket into the filter rod cavity. With the methods described above, the particles fill the cavities loosely and can result in a difference in the firmness of the rod when the filter component sections of the rod spaced in between the cavities have a different density than the particle filled cavity sections. The difference in density or firmness of the particle filled cavities can present a quality control problem when a consistent firmness for the entire article having the cavities or a consistent firmness from one particle filled cavity to another within an article is desired.

SUMMARY OF THE INVENTION

Embodiments of the invention provide methods and apparatus for firmly packing particles or granules in spaced cavities along an article being moved along a manufacturing line. One or more packing mechanisms can be provided downstream of an initial particle filling station in the direction of movement of an article having cavities to be filled with particles or granules. In an embodiment wherein the article with cavities is a combined cigarette filter rod, examples of packing mechanisms for firmly packing the particles in spaced cavities along the filter rod can include a lugged packing wheel, a smooth packing wheel, and a lugged packing belt.

In the case of a lugged packing wheel or a lugged packing belt, or other device having protruding portions that pack only the particles in the spaced cavities, the lugs or protrusions are spaced at a distance that corresponds to the distance between cavities in the article with particles that need to be packed. The lugs are also moved through rotation of the lugged packing wheel or translation of the lugged packing belt at a speed that is synchronized with the speed of movement of the article having cavities to be packed. The synchronization of movement of the packing instrument with movement of the article having cavities ensures that even packing of the particles or granules in the cavities occurs while avoiding damage to the article.

In the case of a combined filter rod or other article having cavities to be filled with particles, side rails can be provided to conform to at least two sides of the article, thereby preventing undesired deformation of the article during the packing process. The side rails in combination with a support rail underneath the article prevent deformation of the article during the packing process while also allowing free movement of the article along the rail support system. An embodiment of the invention can also include the application of vacuum to the support rail. In the case of a combined cigarette filter rod, the porous paper that forms the wrapper of the filter rod allows the vacuum to pull particles into the spaced cavities, thereby helping the compacting process. In additional embodiments, vibration can also be applied to the filter rod or rod support rail to allow the particles to pack tighter as they are being compacted.

BRIEF DESCRIPTION OF THE DRAWINGS

The invention will be better understood upon consideration of the following detailed description, taken in conjunction with the accompanying drawings, in which like parts are referred to with the same reference numeral, and in which:

FIG. 1 illustrates a particle compacting system including a lugged packing wheel;

FIG. 1A illustrates a cross-sectional view taken in the direction of arrows A—A in FIG. 1;

FIG. 1B illustrates a cross-sectional view taken in the direction of arrows B—B in FIG. 1;

FIG. 1C illustrates a cross-sectional view taken in the direction of arrows C—C in FIG. 1;

FIG. 2 illustrates a particle compacting system including a packing wheel;

FIG. 2A illustrates a cross-sectional view taken in the direction of arrows A—A in FIG. 2;

FIG. 2B illustrates a cross-sectional view taken in the direction of arrows B—B in FIG. 2;

FIG. 2C illustrates a cross-sectional view taken in the direction of arrows C—C in FIG. 2;

FIG. 3 illustrates a particle compacting system using a lugged packing belt;

FIG. 3A illustrates a cross-sectional view taken in the direction of arrows A—A in FIG. 3;

FIG. 3B illustrates a cross-sectional view taken in the direction of arrows B—B in FIG. 3;

FIG. 3C illustrates a cross-sectional view taken in the direction of arrows C—C in FIG. 3.

DESCRIPTION OF THE PREFERRED EMBODIMENTS

Figure 4:
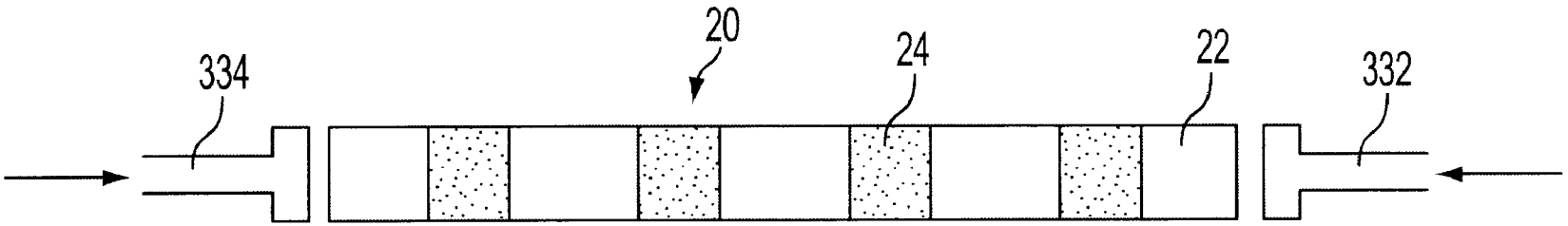
FIG. 4 illustrates a schematic representation of an axial compacting system according to an embodiment of the invention.

The invention provides a system for continuously and rapidly compacting particles or granules within successive cavities along an article to achieve desired density and firmness of the finished product. The system can accommodate rapid movement of the article or articles along the manufacturing line while achieving accurate compaction of the particles in the cavities. Depending on the shape of the cavities that are filled with particles, and the shape of the finished product, the compaction process can be performed in different directions relative to the movement of the article. An article such as a cigarette filter rod that has spaced cavities which are filled with granules or particles in a direction perpendicular to the axis of the rod, can be compacted in a radial direction following the particle filling operation, or alternatively, can be compacted in an axial direction after the cavities have been filled and the wrapping paper has been sealed. In the case of an axially directed compacting operation, plungers could be provided to exert pressure on one end or both ends of a completed length of filter rod having a predetermined number of spaced cavities and filter components. In the case of a radially directed compacting operation, compaction pressure is provided to at least the filled cavities in a direction approximately perpendicular to the movement of the article. This pressure can be provided selectively to only the cavities themselves, or continuously to the entire article including the cavities.

Referring initially to FIGS. 1, 1A, 1B and 1C, a particle compacting system that performs compaction in approximately the same direction as the filling of particles is shown for compacting charcoal or carbon particles in a combined cigarette filter rod. The combined cigarette filter rod 20 is moved along a support rail system including a bottom support rail 40 and side support rails 50, clearly shown in FIGS. 1A, 1B and 1C. The cigarette filter rod 20 is made up of alternate filter components 22 such as cellulose acetate filter components and particle filled cavities 24. The particle filled cavities 24 are filled with loose particles or granules at an initial particle filling station 72, as shown in FIG. 1. Although the initial particle filling station 72 is illustrated schematically as simply showering particles over an area of the combined filter rod 20 that includes both filter components 22 and cavities 24, the particle filling station could also be provided with a pocketed vacuum wheel or other means for applying particles directly to the particle filled cavities 24.

A lugged packing wheel 30 is provided downstream of the initial particle filling station 72. The lugged packing wheel 30 has individual lugs 32 spaced around its outer circumference. The spacing between lugs 32 corresponds to the spacing between particle filled cavities 24 in the moving cigarette filter rod 20. The lugged packing wheel 30 is rotated in the direction of arrow B at a rate of speed that is synchronized with the movement of filter rod 20 in the direction of arrow A. Accordingly, as each particle filled cavity 24 passes underneath the lugged packing wheel 30, individual lugs 32 enter successive cavities and compact the particles 70 in each particle filled cavity 24.

After the particles in particle filled cavities 24 have been compacted by the first lugged packing wheel 30, the article can continue to be moved further downstream to a second particle filling station 74, where additional particles 70 can be added to the compacted particle filled cavities 24. After each of the cavities has been filled sufficiently to achieve 100% filling with additional particles, the article continues to move downstream to an optional second lugged packing wheel 30' having lugs 32'.

During the compacting process, the forces on the particles 70 in each particle filled cavity 24 would tend to push out the sides of the filter rod 20 if the filter rod 20 was unsupported on its sides, due to the flexibility of the wrapping paper. Accordingly, side rails 50, shown in FIG. 1B, can be provided to conform to the sides of the filter rod 20 and prevent a distortion in the shape of the cylindrical rod.

Although two filling stations and compacting lugged wheels are shown in FIG. 1, one of ordinary skill in the art will recognize that the invention is intended to encompass embodiments that may have only a single filling station and compacting wheel, or more than two filling stations and compacting wheels.

A second embodiment of the invention is shown in FIGS. 2, 2A, 2B and 2C, wherein a solid packing wheel 130 is provided downstream of the initial particle filling station 72. The packing wheel 130 is provided with a constant radius outer circumferential surface, and therefore the packing wheel 130 provides an even compacting force to both particles in the cavities 24 and the filter components 22 in between the cavities 24. Similarly to the first embodiment shown in FIGS. 1, 1A, 1B and 1C, the compacting system of the second embodiment can be provided with one or more packing wheels, 130, 130', and one or more particle filling stations, 72, 74. Side rails 150 and bottom support rail 140 maintain the cylindrical shape of the cylindrical rod 20 during the compacting process. If desired, a vacuum can also be applied through the porous paper forming the outside of the filter rod 20. The vacuum applied from the support rail would help to pull the loose particles into the cavities 24 and aid in the compacting process. If desired, the vacuum applied from the support rail can also induce air flow around the filter rod or other article being processed to assist in cleaning loose particles or granules that may lie on surfaces of the article surrounding the cavities.

A third embodiment of a compacting system for compacting loose particles or granules in spaced cavities along a moving article is shown in FIGS. 3, 3A, 3B and 3C. The third embodiment includes one or more particle filling stations 72, 74 and one or more lugged packing belts 230, 230' having spaced lugs 232. The packing belt 230 is driven around the outside circumference of two spaced drive wheels 236, 238. Lugs 232 formed along the lugged packing belt 230 are spaced at a distance that corresponds to the distance between cavities 24 in the article 20 being moved underneath the compacting belt. As with the other embodiments described above, the compacting belt 230 is moved at a speed that is synchronized with the movement of cigarette filter rod or other article 20 so that each lug 232 enters a successive cavity 24 as the article 20 moves underneath the lugged belt. After the particles in each cavity 24 are compacted by the lugged packing belt 230 downstream of the initial particle filling station 72, an additional particle filling station 74 can fill each of the cavities 24 to the top, and an optional second lugged packing belt 230' provided downstream of the second particle filling station can once again compact the particles in each cavity 24.

A fourth embodiment of a compacting system for compacting loose particles or granules in spaced cavities of a cigarette filter rod 20 is shown schematically in FIG. 4. The filter rod 20 can be compacted in a direction parallel to its axis by plungers 332, 334 actuated to press inwardly against one or both ends of the rod.

Side rails 250 and bottom support rail 240, such as shown in FIG. 3C, ensure that the cylindrical shape of the cigarette filter rod 20 is maintained during the compacting process. One of ordinary skill in the art will recognize that the outer periphery of the article having cavities to be filled does not have to be cylindrical as in the above-described embodiments, but could assume any other desired shape.

What is claimed is:

1. A method for manufacturing an article having cavities filled with loose particles or granules, the cavities being spaced from each other by intermediate components, said method comprising:

moving said article along a path;

adding particles to at least one of said cavities at a first station so that said at least one cavity is at least partially filled with said particles;

compacting the particles in said at least one cavity;

filling said at least one cavity in which particles have been compacted with additional particles at a second station; and compacting the additional particles in said at least one cavity.

2. The method according to claim 1, wherein the compacting is performed by first and second rotating wheels of substantially constant outer diameter.

3. The method according to claim 1, wherein said compacting is performed with first and second rotating wheels, each having spaced lugs around the outer periphery of the wheel, the spaced lugs entering each of the cavities as the article moves along said path.

4. The method according to claim 1, wherein said compacting is performed with first and second moving belts, each having spaced lugs along at least part of the length of the belt, the spaced lugs entering each of the cavities as the article moves along said path.

5. The method according to claim 1, further including the step of applying a vacuum to the article to generate a negative pressure in the cavities.

6. A system for compacting particles or granules in spaced cavities along an article being moved along a manufacturing line, the system comprising:

a support rail having a surface shaped for conforming to at least part of an outer periphery of the article;

a first filling station at which particles are introduced into at least one of said cavities;

a first pressure applicator positioned in proximity to said support rail, said first pressure applicator compacting the particles that have been introduced at the first filling station into said at least one of said cavities, said compaction by said first pressure applicator being synchronized with movement of the article along the support rail;

a second filling station at which additional particles are introduced into said at least one of said cavities containing compacted particles; and a second pressure applicator positioned in proximity to said support rail, said second pressure applicator compacting the particles that have been introduced at the second filling station into said at least one of said cavities, said compaction by said second pressure applicator being synchronized with movement of the article along said support rail.

7. The system according to claim 6, wherein at least one of said first and second pressure applicators is a wheel that is rotated in synchronization with the movement of the article along the support rail.

8. The system according to claim 7, wherein said wheel has a constant outer diameter.

9. The system according to claim 7, wherein said wheel includes spaced protrusions around the outer periphery of the wheel.

10. The system according to claim 9, wherein the distance between said spaced protrusions corresponds to the distance between the spaced cavities in the article.

11. The system according to claim 6, wherein said support rail includes at least a bottom surface and two side surfaces conforming to and supporting the bottom and sides of the article during compaction of the particles or granules.

12. The system according to claim 11, wherein at least one of said first and second pressure applicators is a wheel that is rotated in synchronization with the movement of the article along the support rail.

13. The system according to claim 12, wherein said wheel has a constant outer diameter.

14. The system according to claim 12, wherein said wheel includes spaced protrusions around the outer periphery of the wheel.

15. The system according to claim 14, wherein the distance between said spaced protrusions corresponds to the distance between the spaced cavities in the article.

16. The system according to claim 6, wherein at least one of said first and second pressure applicators is a belt that moves in synchronization with movement of the article along the support rail.

17. The system according to claim 16, wherein said belt has spaced protrusions along at least a portion of the length of the belt.

18. The system according to claim 17, wherein the distance between said spaced protrusions corresponds to the distance between the spaced cavities in the article.

19. A method for manufacturing an article having cavities filled with loose particles or granules, the cavities being spaced from each other by intermediate components, said method comprising:

moving said article along a path;

adding particles to at least one of said cavities at a first station so that said at least one cavity is at least partially filled with said particles;

compacting the particles in said at least one cavity; and filling said at least one cavity in which particles have been compacted with additional particles at a second station.

20. The method according to claim 19, wherein the compacting is performed by a rotating wheel.

21. The method according to claim 19, wherein said compacting is performed with a rotating wheel having spaced lugs around the outer periphery of the wheel, the spaced lugs entering each of the cavities as the article moves along said path.

22. The method according to claim 19, wherein said compacting is performed with a moving belt having spaced lugs along at least part of the length of the belt, the spaced lugs entering each of the cavities as the article moves along said path.

23. The method according to claim 19, further including the step of applying a vacuum to the article to generate a negative pressure in the cavities.

24. A system for compacting particles or granules in spaced cavities along an article being moved along a manufacturing line, the system comprising:

a support rail having a surface shaped for conforming to at least part of an outer periphery of the article;

a first filling station at which particles are introduced into at least one of said cavities;

a first pressure applicator positioned in proximity to said support rail, said first pressure applicant compacting the particles that have been introduced at the first filling station into said at least one of said cavities, said compaction by said first pressure applicator being synchronized with movement of the article along the support rail; and a second filling station at which additional particles are introduced into said at least one of said cavities containing compacted particles.

25. The system according to claim 24, wherein said pressure applicator is a wheel that is rotated in synchronization with the movement of the article along the support rail.

26. The system according to claim 25, wherein said wheel has a constant outer diameter.

27. The system according to claim 25, wherein said wheel includes spaced protrusions around the outer periphery of the wheel.

28. The system according to claim 27, wherein the distance between said spaced protrusions corresponds to the distance between the spaced cavities in the article.

29. The system according to claim 24, wherein said support rail includes at least a bottom surface and two side surfaces conforming to and supporting the bottom and sides of the article during compaction of the particles or granules.

30. The system according to claim 29, wherein said pressure applicator is a wheel that is rotated in synchronization with the movement of the article along the support rail.

31. The system according to claim 30, wherein said wheel has a constant outer diameter.

32. The system according to claim 30, wherein said wheel includes spaced protrusions around the outer periphery of the wheel.

33. The system according to claim 32, wherein the distance between said spaced protrusions corresponds to the distance between the spaced cavities in the article.

34. The system according to claim 24, wherein said pressure applicator is a belt that moves in synchronization with movement of the article along the support rail.

35. The system according to claim 34, wherein said belt has spaced protrusions along at least a portion of the length of the belt.

36. The system according to claim 35, wherein the distance between said spaced protrusions corresponds to the distance between the spaced cavities in the article.

* * * * *